US006724381B2

(12) United States Patent
Sakashita

(10) Patent No.: US 6,724,381 B2
(45) Date of Patent: Apr. 20, 2004

(54) SIGNAL PROCESSING APPARATUS FOR GENERATING CLOCKS PHASE-SYNCHRONIZED WITH INPUT SIGNAL

(75) Inventor: Yukihiko Sakashita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/534,335

(22) Filed: Mar. 24, 2000

(65) Prior Publication Data

US 2003/0156107 A1 Aug. 21, 2003

(30) Foreign Application Priority Data

Mar. 26, 1999 (JP) ..... 11-084381
Mar. 24, 2000 (JP) ..... 2000-083856

(51) Int. Cl.[7] ..... G09G 5/00
(52) U.S. Cl. ..... 345/213; 348/537
(58) Field of Search ..... 345/213; 348/500, 348/537, 572, 607

(56) References Cited

U.S. PATENT DOCUMENTS 5,864,495 A 1/1999 Sakashita et al. ..... 364/807
5,990,968 A * 11/1999 Naka et al. ..... 348/537
6,097,379 A * 8/2000 Ichiraku ..... 345/213
6,097,444 A * 8/2000 Nakano ..... 348/537
6,100,724 A * 8/2000 Yoshimura et al. ..... 327/100
6,268,848 B1 * 7/2001 Eglit ..... 345/204
6,304,296 B1 * 10/2001 Yoneno ..... 348/536
6,340,993 B1 * 1/2002 Hasegawa et al. ..... 348/572

FOREIGN PATENT DOCUMENTS

JP 402260820 A * 10/1990

* cited by examiner

*Primary Examiner*—Bipin Shalwala
*Assistant Examiner*—Ricardo Osorio
(74) *Attorney, Agent, or Firm*—Fitzpatrick, Cella, Harper & Scinto

(57) ABSTRACT

An image signal processing apparatus has a clock generation circuit for generating a clock which is phase-synchronized with an input image signal, a sampling circuit for sampling the input image signal in response to the clock, a comparator circuit for comparing a plurality of samples output from the sampling circuit with each other, and a control circuit for controlling a phase of the clock by controlling the clock generating circuit in accordance with a comparison result by the compartor circuit.

26 Claims, 11 Drawing Sheets

IMAGE DATA

SAMPLING TIMING 1

DATA 1 AFTER SAMPLING

SAMPLING TIMING 2

DATA 2 AFTER SAMPLING

SAMPLING TIMING 3

IMAGE DATA

SAMPLING TIMING 1

DATA 1 AFTER SAMPLING

SAMPLING TIMING 2

DATA 2 AFTER SAMPLING

SAMPLING TIMING 1

DATA 1 AFTER SAMPLING

DIFFERENCE DATA Dmax(n)−Dmax(n−1)

SAMPLING TIMING 2

DATA 2 AFTER SAMPLING

DIFFERENCE DATA Dmax(n)−Dmax(n−1)

SIGNAL PROCESSING APPARATUS FOR GENERATING CLOCKS PHASE-SYNCHRONIZED WITH INPUT SIGNAL

BACKGROUND OF THE INVENTION

1. Field of the Invention

The present invention relates to a signal processing apparatus, and more particularly to an apparatus for generating clocks phase-synchronized with an input signal.

2. Related Background Art

A conventional liquid crystal display apparatus is required to reproduce and display image signals of various kinds with high fidelity, the image signals including those sent from external computers of a different maker and those having different pixel frequencies. In order to satisfy this requirement, an image mode discrimination unit discriminates between image modes based upon the horizontal sync signal HD and vertical sync signal VD of an input image signal to determine a pixel frequency suitable for the image mode and set the frequency to a PLL circuit. By using the horizontal sync signal HD as a reference, the PLL circuit generates clocks having a frequency N times as high as that of the horizontal sync signal HD, and samples the image or video signal for A/D conversion which uses the clocks.

The PLL circuit therefore determines the phase of the sampling clock for A/D conversion by using the horizontal sync signal HD as a reference. However, the phase relation between the horizontal sync signal HD and the image signal is not always constant because distortion, jitter and the like of the horizontal sync signal HD are influenced by differences in image output apparatus such as computers to be connected and differences in connection wiring lengths. It is therefore necessary to set the sampling phase independently for each apparatus to be connected. A shift in the sampling phase is a main factor in image quality degradation, particularly the image quality of a multi-scan display is required to process various image modes. If pixel data is not sampled at its optimum point, the dynamic range and gradation become narrow so that the image quality is conspicuously degraded having low contrast, large noises and the like and a high image quality is difficult to display.

If a horizontal sync signal having an integrated waveform portion is input to a liquid crystal display apparatus, the timing of a reference signal or horizontal sync signal cannot be detected correctly. In this case, if the sampling point is near the border between the preceding and succeeding pixels, uniform pixel data cannot be obtained and flickering may occur because of jitter.

If a plurality of personal computers are connected in a switching manner to a large screen display apparatus of a conference system or education system, it is more difficult to obtain an optimum sampling phase, because the phases of the horizontal sync signal and image signal of each personal computer are different and in addition because the horizontal sync signal becomes unsharp since each personal computer is connected via a long wire to an image signal switching circuit.

SUMMARY OF THE INVENTION

It is an object of the present invention to solve the above-described problems.

It is another object of the present invention to control the sampling phase of an image signal to have an optimum phase.

Under such objects, according to an aspect of the present invention, there is provided an image signal processing apparatus comprising: clock generating means for generating a clock phase-synchronized with an input image signal; sampling means for sampling the input image signal in response to the clock; comparison means for comparing a plurality of samples output from the sampling means with each other; and control means for controlling a phase of the clock by controlling the clock generating means in accordance with a comparison result by the comparison means.

The other objects and features of the present invention will become apparent from the following detailed description of the invention when read in conjunction with the accompanying drawings to follow.

DETAILED DESCRIPTION OF THE PREFERRED EMBODIMENTS

Embodiments of the invention will be described with reference to the accompanying drawings.

Figure 1:
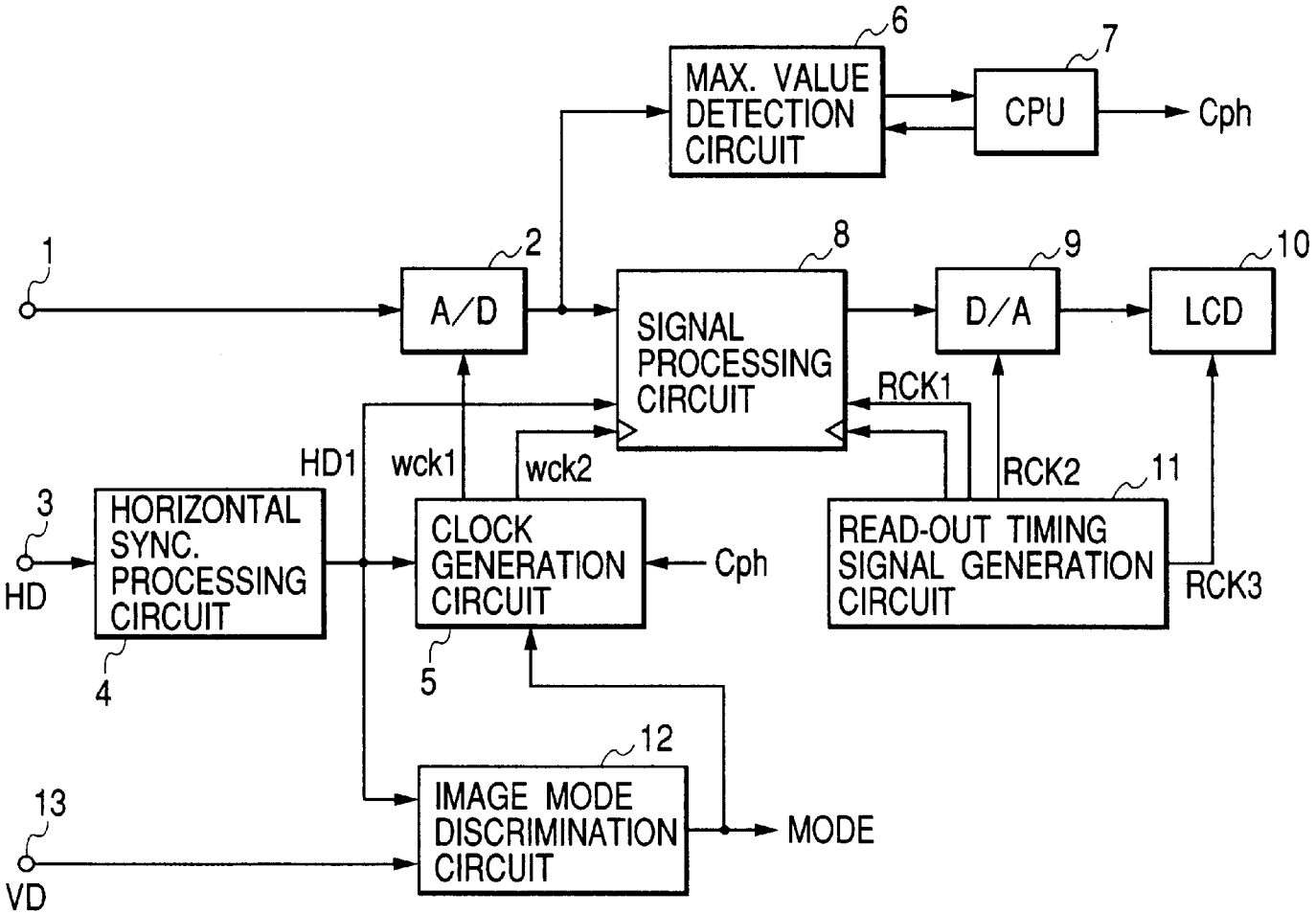
FIG. 1 is a block diagram showing a liquid crystal display apparatus using an image signal processing apparatus according to a first embodiment of the invention.

FIG. 1 is a block diagram showing a liquid crystal display apparatus using an image signal processing apparatus according to the first embodiment of the invention.

In FIG. 1, reference numeral 1 represents an input terminal to which a video signal is input from each external apparatus such as a computer, and reference numeral 2 represents an A/D converter for sampling a video signal input from the input terminal 1, and quantizing each sample to convert it into a digital signal having a plurality of bits per one sample.

Reference numeral 3 represents a horizontal sync signal input terminal to which a horizontal sync signal HD is input, reference numeral 4 represents a horizontal sync processing circuit for processing a horizontal sync signal input from the horizontal sync signal input terminal 3, and reference numeral 5 represents a clock generation circuit for receiving a horizontal sync signal HD1 output from the horizontal sync processing circuit 4 and includes a PLL circuit which generates a clock wck1 having a frequency N times that of HD1 and locked to HD1 and a timing signal wck2 for signal processing.

Reference numeral 6 represents a max value detection circuit for detecting a max value of a video signal sampled by the A/D converter 2, and reference numeral 7 represents a CPU for generating and outputting a detection start signal to the max value detection circuit 6 and generating a signal Cph for controlling the phase of the clock in accordance with the max value detection result of the max value detection circuit 6 and outputting the signal Cph to the clock generation circuit 5. Reference numeral 8 represents a signal processing circuit for receiving a video signal output from the A/D converter and executing various signal processing such as contrast adjustment, brightness adjustment and gamma correction, and resolution conversion by a scan convertor or the like if a multi-scan display apparatus is used.

Reference numeral 9 represents a D/A circuit for converting an output of the signal processing circuit 8 into an analog signal, reference numeral 10 represents a liquid crystal display (LCD) apparatus for displaying a video signal output from the D/A converter 9, and reference numeral 11 represents a read-out timing signal generation circuit for supplying the signal processing circuit 8, D/A converter 9 and LCD 10 with a timing signal Rck1, a clock Rck2, and a timing signal Rck3, respectively. Reference numeral 13 represents an input terminal for a vertical sync signal VD, and reference numeral 12 represents an image mode discrimination circuit for discriminating between image modes of input video signals in accordance with the horizontal sync signal HD and vertical sync signal VD, for determining the pixel frequency suitable for the discriminated image mode, and for setting the clock frequency to the PLL circuit. In accordance with the discriminated image mode, the operation mode of each circuit is set.

The structure of the main part of the clock generation circuit 5 of FIG. 1 is shown in FIG. 13.

Figure 12:
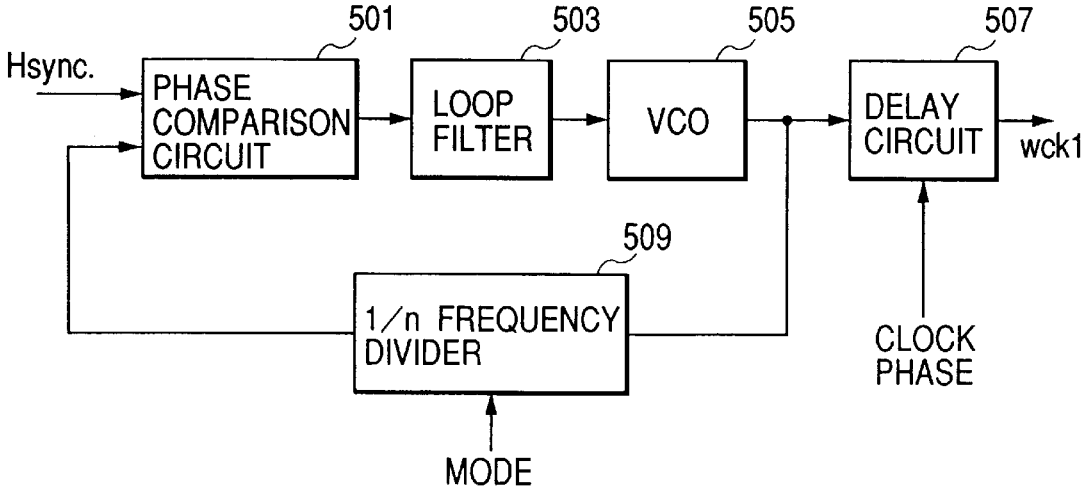
FIG. 12 is a block diagram showing the structure of the main part of a clock generation circuit shown in FIG. 1.

Referring to FIG. 12, a phase comparison circuit 501 is input with the horizontal sync signal from the horizontal sync processing circuit 4 and an output from a 1/n frequency divider 509. A phase difference between these two signals is detected by the phase comparison circuit 501, and supplied via a loop filter 503 to a voltage-controlled oscillator (VCO) 505. VCO 505 generates a clock having a frequency corresponding to its input signal and outputs it to a delay circuit 507 and the 1/n frequency divider 509.

The frequency divider 509 is constituted of a counter and frequency-divides the clock output from VCO by 1/n to output the division result to the phase comparison circuit 501. As will be later descried, the frequency division ratio n of the frequency divider 509 can be changed in accordance with the image mode signal discriminated by the image mode discrimination circuit 12.

The delay circuit 507 controls the phase of the clock output from VCO 505 and outputs the signal wck1. The output phase (output timing) of the clock from the delay circuit 507 is set by a control signal supplied prom CPU 7 (shown in FIG. 1).

Next, with reference to FIGS. 2A to 2F, the principle of a display position adjusting method for the liquid crystal apparatus according to the present embodiment will be described. FIGS. 2A to 2F are timing charts illustrating the relation among image data in a video signal, sampling timings, and image data after sampling.

Figure 2A:
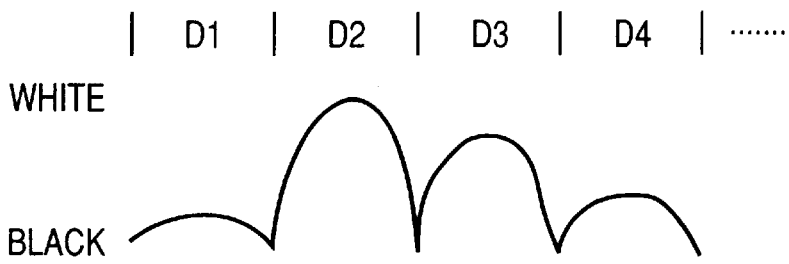
FIGS. 2A, 2B, 2C, 2D, 2E and 2F are timing charts illustrating the operation of the first embodiment.
Figure 2B:
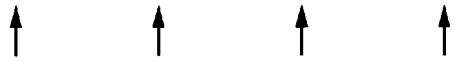
Figure 2C:
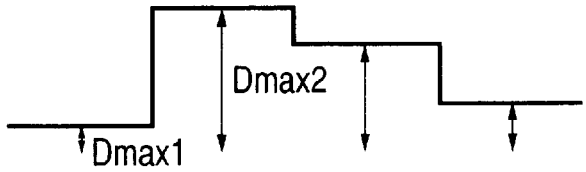

As shown in FIG. 2A, image data of each pixel D1, D2, D3, . . . output from a CCD or the like and having a reset potential has a mountain-like shape rising from a black level toward a white level. Therefore, if the image data is sampled at the peak (max) of each mountain-shaped signal at the sampling timings shown in FIG. 2B, the sampled data provides an effective dynamic range as shown in FIG. 2C and can obtain a high contrast image.

Figure 2D:
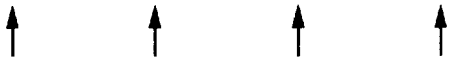
Figure 2E:
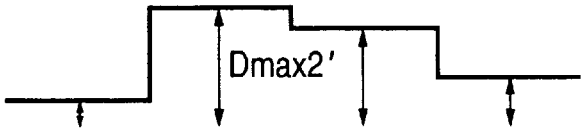

However, if the image data is sampled at the position other than the peak of the image signal at the timings shown in FIG. 2D, the sampled data provides a narrow dynamic range as shown in FIG. 2E so that the image has a low contrast, large noised and poor gradation. If the image data is sampled at the position between two preceding and succeeding pixels at the timing shown in FIG. 2F, jitter occurs and the image of irregular pixel data is obtained, thereby further degrading the image quality.

Figure 2F:
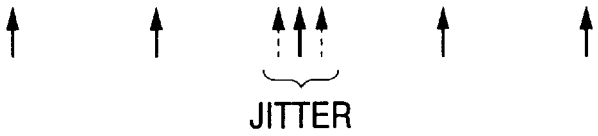

In this embodiment, therefore, the max value detection circuit 6 for detecting the max value of the signal level is provided to detect the max value as an optimum signal point. Even if the sampling timings shown in FIGS. 2D and 2F are used, they are automatically corrected to the optimum sampling timings shown in FIG. 2A.

The process of controlling such a clock phase by CPU 7 will be described with reference to the flowchart shown in FIG. 3.

First at step S301, CPU 7 controls the max value detection circuit 6 which detects the max value Dmax of the output data from the A/D converter 2, by comparing the levels of video signals of respective samples in a designated image area A (e.g., one line or one frame). Next at step S302, CPU 7 controls the clock generation circuit 5 which changes the clock phase by ΔT from the previous clock phase to thereby change sampling timings. Thereafter, similar to the above, the max value Dmax (1) of sample values of a predetermined line is detected. In this case, the change direction of the phase may be in either a phase lead or a phase lag direction.

Next, Dmax and Dmax (1) are compared (S303). If Dmax (1) is larger than Dmax, then Dmax is set to Dmax (1) and the clock phase is stored in an internal memory (S304). If Dmax (1) is equal to or smaller than Dmax, the flow advances to step S305.

At step S305 it is checked whether the comparison step has been executed predetermined times. If not, the flow returns back to step S302 to repeat similar operations, whereas if executed, the clock phase corresponding to Dmax stored in the internal memory is read, and the clock generation circuit 5 is controlled to be set to the clock phase corresponding to Dmax.

Figure 3:
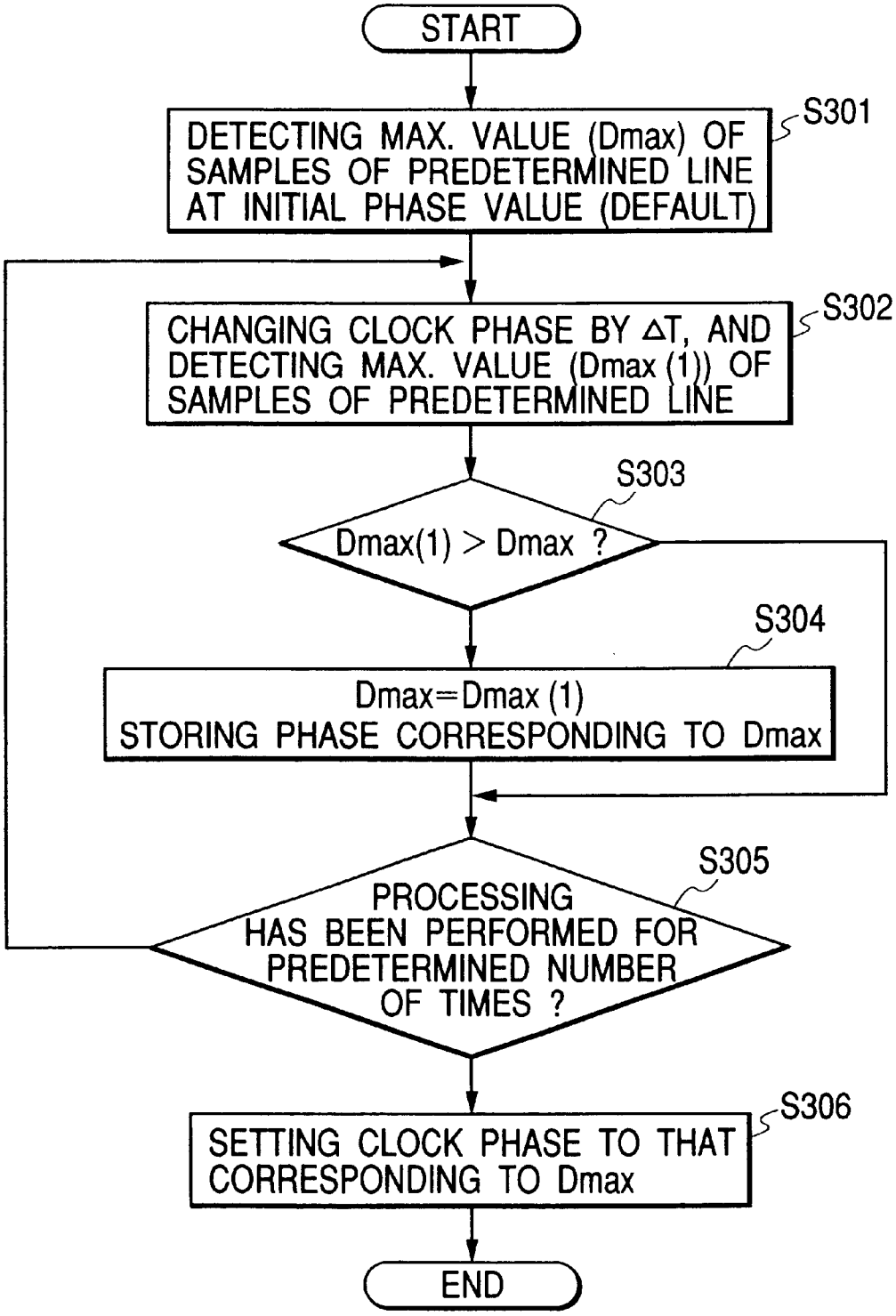
FIG. 3 is a flowchart illustrating the operation of the first embodiment.

According to the process illustrated in FIG. 3, the sampling point is shifted sequentially by ΔT during one pixel period, the max value Dmax (n) is detected, and the sampling point PH (n) at that time is used as an optimum phase value. ΔT is associated with the one pixel period between adjacent pixels, and in this embodiment takes a value obtained by equally dividing the one pixel period by n.

With this process, an optimum sampling point can be automatically obtained.

In this embodiment, although a positive polarity signal is used for detecting the signal max value, a negative polarity signal may also be used in a similar manner to detect a max amplitude value. In the case of a CCD signal used in this embodiment, although it is a negative polarity signal, an inverted signal has been used for the description of the embodiment.

The clock phase adjustment of this embodiment is executed at a predetermined timing.

Namely, it may be executed when the power is turned on, everytime when the mode suitable for an input image source is switched, at a predetermined interval in time, or everytime when a temperature changes.

As the second embodiment of the invention, a method of more effectively detecting a sampling phase of a signal of a different type from the signal used in the first embodiment.

In the first embodiment, it is possible to obtain an optimum sampling point of a video signal having a mountain-like shape with a reset potential with a simple process.

Figures 4A, 4B, 4C, 4D, 4E:
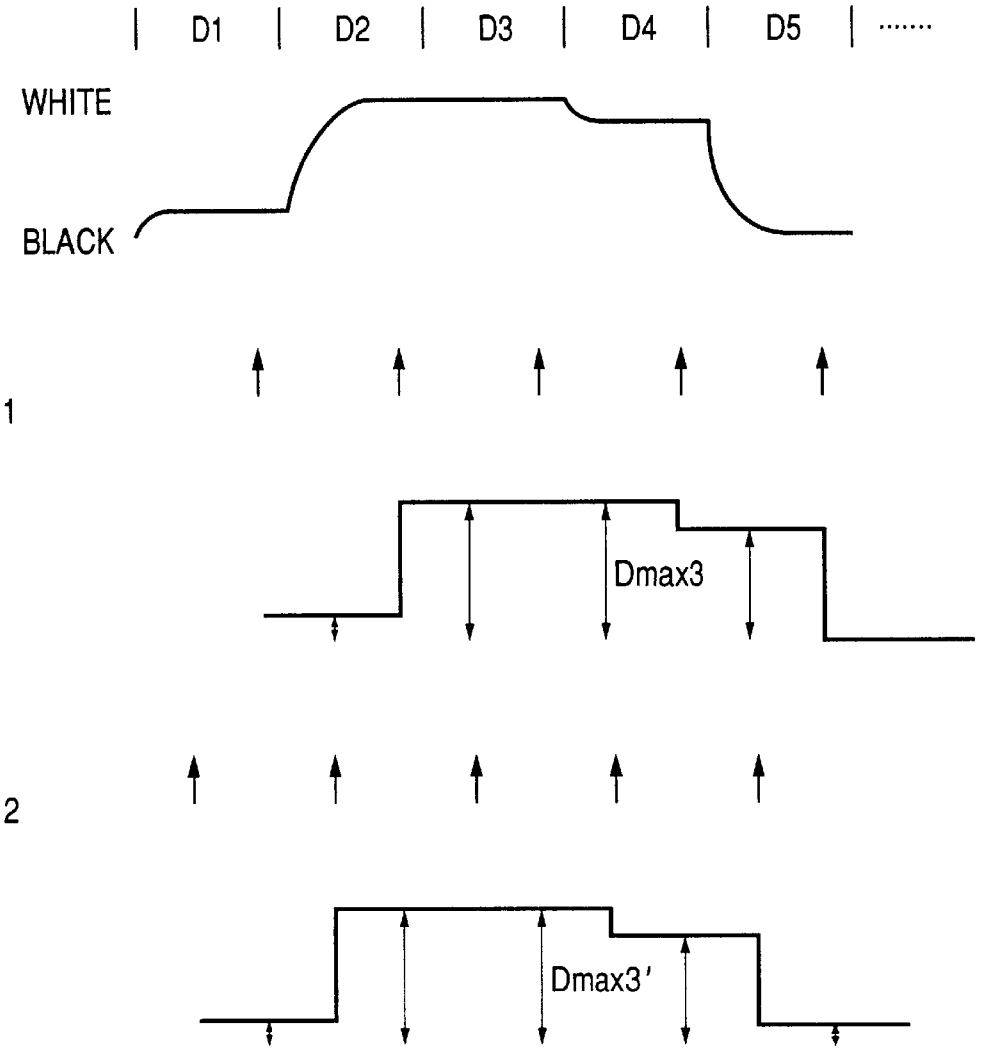
FIGS. 4A, 4B, 4C, 4D and 4E are timing charts illustrating the operation of a second embodiment.

A video signal output from a D/A converter of a graphic board has a stepwise shape as shown in FIG. 4A. In this case, if two or more pixels have the max value, the optimum phase cannot be detected because the max value is always obtained even if the sampling point is shifted.

For example, in FIGS. 4A to 4E, even if the sampling timing for the pixel D3 is shifted from FIG. 4B to FIG. 4D, the sampled values have the same value as shown in FIGS. 4C and 4E so that the optimum phase cannot be detected.

In the first embodiment, the clock phase can be easily adjusted if an image having consecutive black and white pixels in the horizontal direction, such as a resolution test pattern, is used.

The second embodiment provides a method of obtaining an optimum sampling timing of a stepwise video signal without using a resolution test pattern or the like.

Figure 5A:
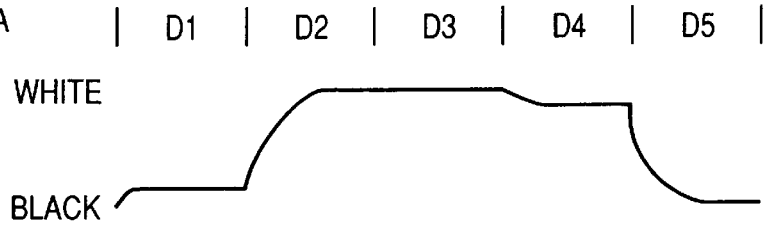
FIGS. 5A, 5B, 5C, 5C' 5D, 5E and 5E' are timing charts illustrating the operation of a third embodiment.
Figure 5B:
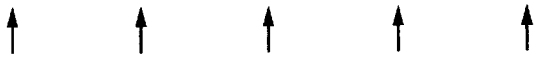
Figure 5C:
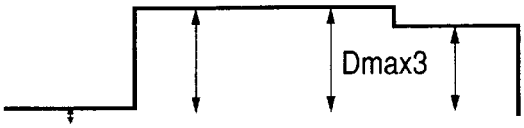
Figure 5C:
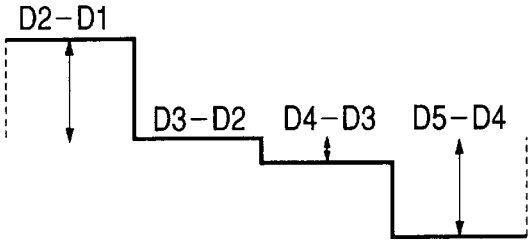
Figure 5D:
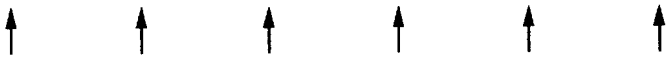
Figure 5E:
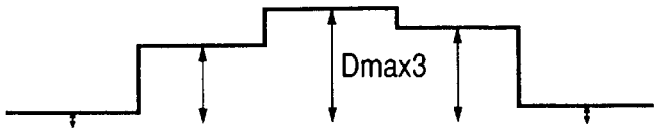
Figure 5E:
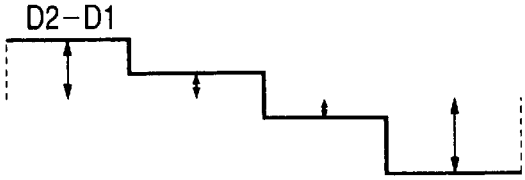

Referring to FIGS. 5A to 5E, if the max value is detected from a stepwise signal shown in FIG. 5A at the timings shown in FIGS. 5B and 5D, the max values of two consecutive pixels appear as shown in FIGS. 5C and 5E so that the optimum phase cannot be detected. In this embodiment, as shown in FIGS. 5C' and 5E', a difference (edge amount) from an adjacent pixel (sample pixel) is detected. Therefore, the clock phase can be controlled by sampling the image data at the position different from the intermediate pixel among pixels providing consecutive max values.

The operation is similar to the first embodiment. A different point is that a difference between adjacent samples is obtained and respective references are compared to obtain the max value by the max value detection circuit 6 (shown in FIG. 1).

If the difference signals of only the positive polarity are used, it is possible to detect the leading edges of the image signal, whereas if the difference signals of only the negative polarity are used, it is possible to detect the trailing edges of the image signal.

Therefore, by comparing the absolute values of the difference signals, it is possible to obtain an optimum sampling phase by detecting both the leading and trailing edges.

In the third embodiment of the invention, the edge amounts of the target pixel relative to both adjacent pixels are detected, or the target pixel and both the adjacent pixels are compared and only if the target pixel is larger than the adjacent pixel values, it is used as a detection pixel. Only when the target pixel is judged as the detection pixel, the max value is stored which is compared with the max value of the next obtained detection pixel.

In this manner, a target pixel and at least one adjacent pixel are compared, and it is judged from this comparison result whether the target pixel is suitable for the detection pixel. According to this method, two or more consecutive pixels having the same value can be removed from the detection pixel. Therefore, the clock phase of even a stepwise image signal can be controlled to have an optimum sampling phase.

In the first embodiment, an optimum phase is set by using the maximum value of an input video signal in a designated line. It can therefore be difficult to set an optimum phase for a moving image changing one frame after another.

Since the line for which the max value is detected is designated in one frame, it takes one frame period in order to obtain a max value for the sampling at the next sampling phase. It takes therefore a long time to detect the max value for all sampling phases in one pixel period.

In the fourth embodiment of the invention, therefore, a method of quickly adjusting the optimum sampling phase without identifying the image area for sampling phase adjustment, will be described.

Figure 6:
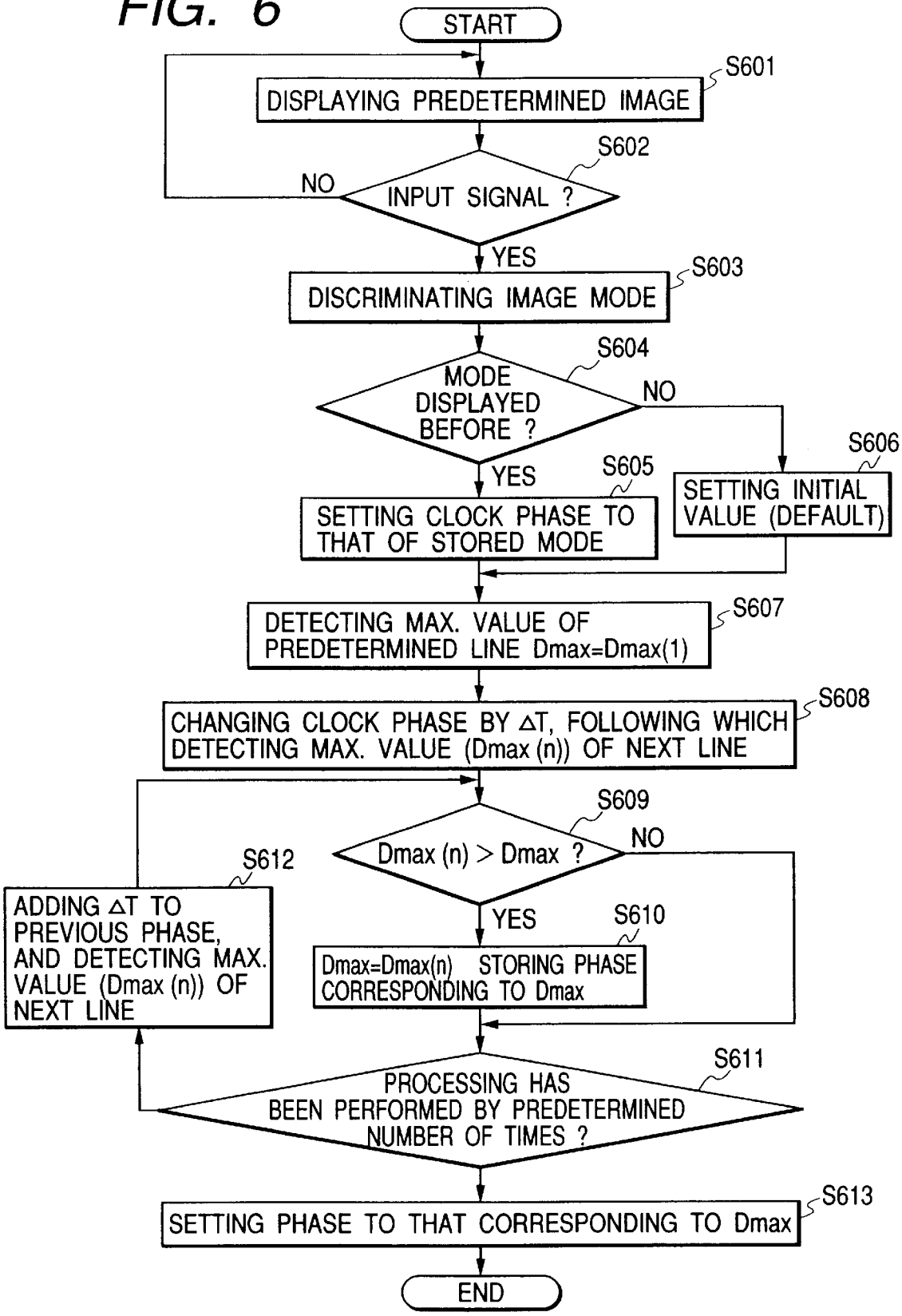
FIG. 6 is a flowchart illustrating the operation of a fourth embodiment.

FIG. 6 is a flowchart illustrating the clock phase control operation by CPU 7 shown in FIG. 1.

When a new image signal is input such as when the power is turned on or when the image source is switched, the signal processing circuit 8 is controlled to display a predetermined image such as blue back and screen saver (S601).

In this embodiment, a predetermined image is displayed and an image by the input image signal is not displayed until the adjustment for the input image signal is established. A unstable image during the adjustment is not therefore displayed.

For example, if R, G and B each have 8 bits, data (R, G, B)=(0, 0, 255) is output to display blue back.

Alternatively, an image stored in a memory area of the signal processing circuit 8 is displayed.

Next, it is checked from the horizontal sync signal HD or vertical sync signal VD whether there is an input signal (S602).

If there is an input image signal, the following phase adjustment process is executed.

First, an image mode is discriminated (S603). It is possible to discriminate between image modes from the timing relation between the horizontal sync signal HD and vertical sync signal VD.

The mode discrimination includes, for example, discrimination of an image size, a pixel frequency, a horizontal frequency, a vertical frequency, respectively of an input image signal, and discrimination between an interlace signal and a progressive signal.

Next, if the image mode judged is used in the past (S604), the clock initial phase is set to a predetermined phase corresponding to the mode and previously stored (S605). If not, a default value is set (S606).

Next, the max value in predetermined lines (assumed to be two lines) in one frame is detected at the set phase, and stored as current Dmax (S607).

As the method of detecting the max value, the method of detecting the max value of the difference (differential) value from predetermined adjacent pixels in the image area region, as described with the first to third embodiments, is used.

Next, the phase is changed in a predetermined direction (lead or lag direction) by a predetermined value $\Delta T$, to obtain the max value in the next two lines which value is stored as a variable Dmax (n) of the comparison object (S608). This variation amount $\Delta T$ is a value obtained by equally dividing one pixel period by n similar to the above-described embodiment.

Dmax is compared with the presently obtained max value Dmax (n) (S609). If Dmax (n) is larger, Dmax is set to the present max value Dmax (n) and the present phase is stored (S610).

If the present Dmax (n) is equal to or smaller than Dmax, the present phase is not stored but the previous phase value is maintained stored to thereafter advance to S611.

Next, it is checked whether the max value judgement for each clock phase has been performed predetermined times (during one pixel period) (S611). If not completed, ΔT is added to the previous clock phase, and then the max value for the next two lines is obtained and stored as Dmax (n) (S612). Thereafter, Dmax (n) is compared with Dmax at S708.

If the max value judgement has been performed predetermined times, the clock generation circuit 5 is controlled and the clock phase is set to the clock phase corresponding to the stored Dmax, and the image corresponding to the input video signal is displayed (S613).

With the above process, an optimum display becomes possible.

Consider now that the sampling phase is adjusted at 64 steps in one pixel. In this case, ΔT is 1/64 of one pixel period.

As in this embodiment, if the max value in two lines is obtained per one step, it is necessary for the max value detection for all clock phases to use 64 steps×2 lines=128 lines in total. For example, if an image signal of XGA 60 Hz of the VESA specification is to be processed, the optimum phase can be obtained in as short as 2.6 ms for 128 lines because the horizontal frequency is 48.363 KHz (20.7 μs).

As above, in this embodiment, it is not necessary to use a specific line of an input image signal to detect the optimum clock phase. It is therefore possible to very quickly obtain a high quality image at an optimum sampling rate.

In the fourth embodiment, the optimum clock phase is detected by obtaining the max value of samples at all clock phases during one pixel period. In the fifth embodiment of the invention, the number of times of obtaining the sample max value is reduced to allow the optimum clock phase to be obtained more quickly.

Figure 7:
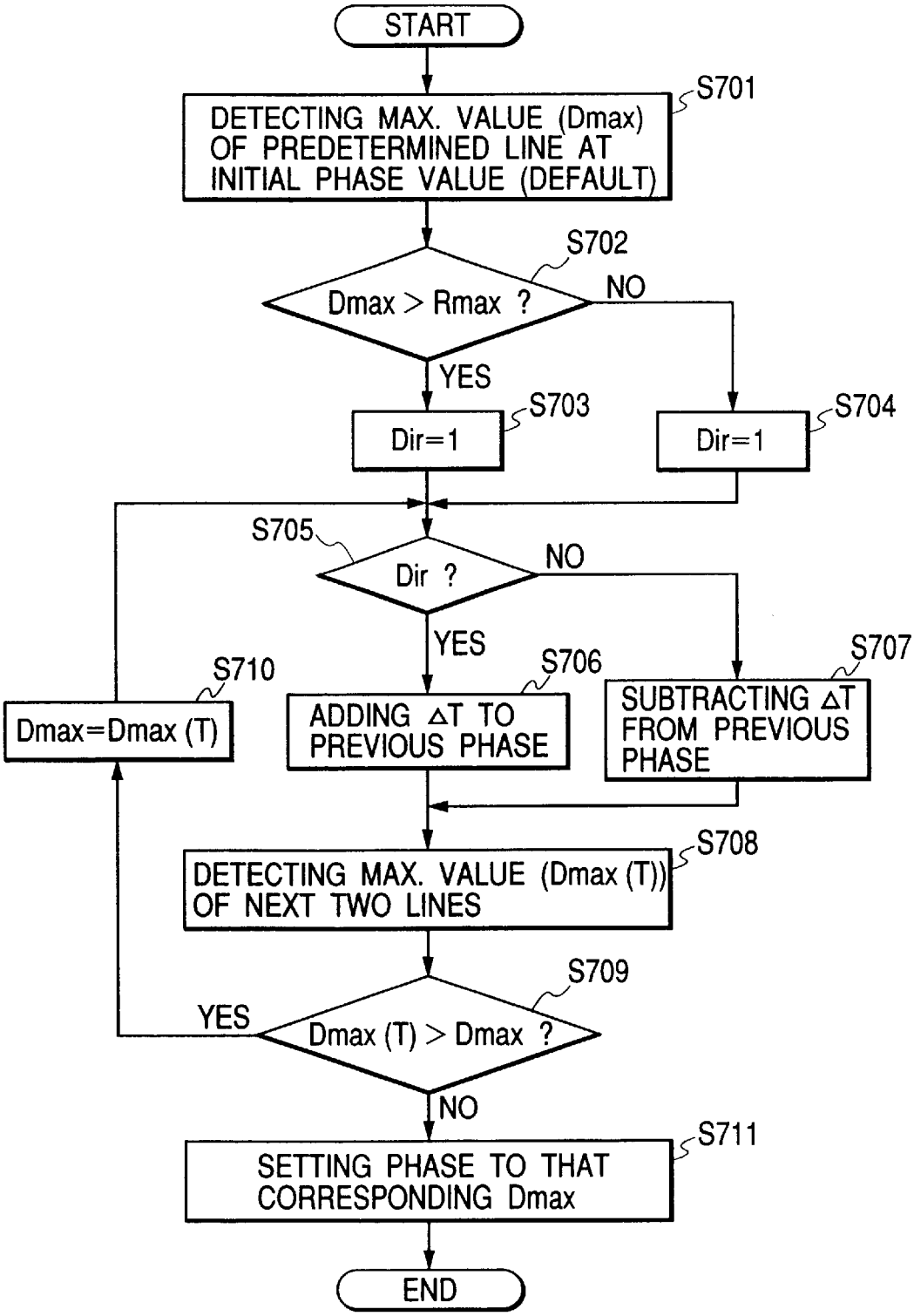
FIG. 7 is a flowchart illustrating the operation of a fifth embodiment.

FIG. 7 is a flowchart illustrating the control operation by CPU 7 according to the fifth embodiment of the invention.

First, the clock phase is set to a predetermined initial phase value (default), the max value of samples in predetermined lines (in this example, two lines) is obtained and stored as Dmax (S701).

Next, a predetermined value Rmax stored in advance in CPU 7 is compared with Dmax (S702). If Dmax is larger than Rmax, a flag Dir is set to 1 to thereby set the direction of changing the clock phase to a plus direction (phase lead direction) (S703). If Dmax (T) is equal to or smaller than Rmax, a flag Dir is set to 0 to thereby set the direction of changing the clock phase to a minus direction (phase lag direction) (S704).

The direction of changing the clock phase is judged from the flag Dir (S705). If Dir is 1, ΔT is added to the previous phase (S706), whereas if Dir is 0, ΔT is subtracted from the previous phase (S707). The image signal is sampled at the changed clock phase, and the max value of image data in the next two lines is detected and stored as Dmax (T) (S708).

Next, Dmax (T) is compared with Dmax (S 709). If the presently detected Dmax (T) is larger than Dmax, Dmax is stored as Dmax (T) and the clock phase at this time is stored (S710) to thereafter return to S705 and repeat the above processes. If Dmax (T) is equal to or smaller than Dmax, the clock phase corresponding to Dmax is read and the clock generation circuit 5 is controlled to set the phase of an output clock to the read clock phase (S711). An image signal is sampled at the set clock and displayed.

As described above, in this embodiment, a max value of an input image signal in predetermined lines is compared with the reference value to set the direction of changing the clock phase, and the clock phase is thereafter changed in the set direction to search the clock phase which can obtain the max value of samples of the image signal. Then at S709 when the max value of samples obtained by changing the clock phase becomes equal to or smaller than the previous max value, this max value is used as the optimum clock phase corresponding to Dmax to thereafter terminate the flow.

Therefore, in many cases, it is not necessary to detect the max value for all clock phases during one pixel period, and the optimum phase can be detected more faster than the fourth embodiment.

According to the embodiment, since the optimum clock phase can be detected more quickly, the image quality is not degraded by the phase adjustment and the adjustment processes from S701 to S711 can be executed while the image is displayed.

Next, the sixth embodiment will be described.

Figure 8:
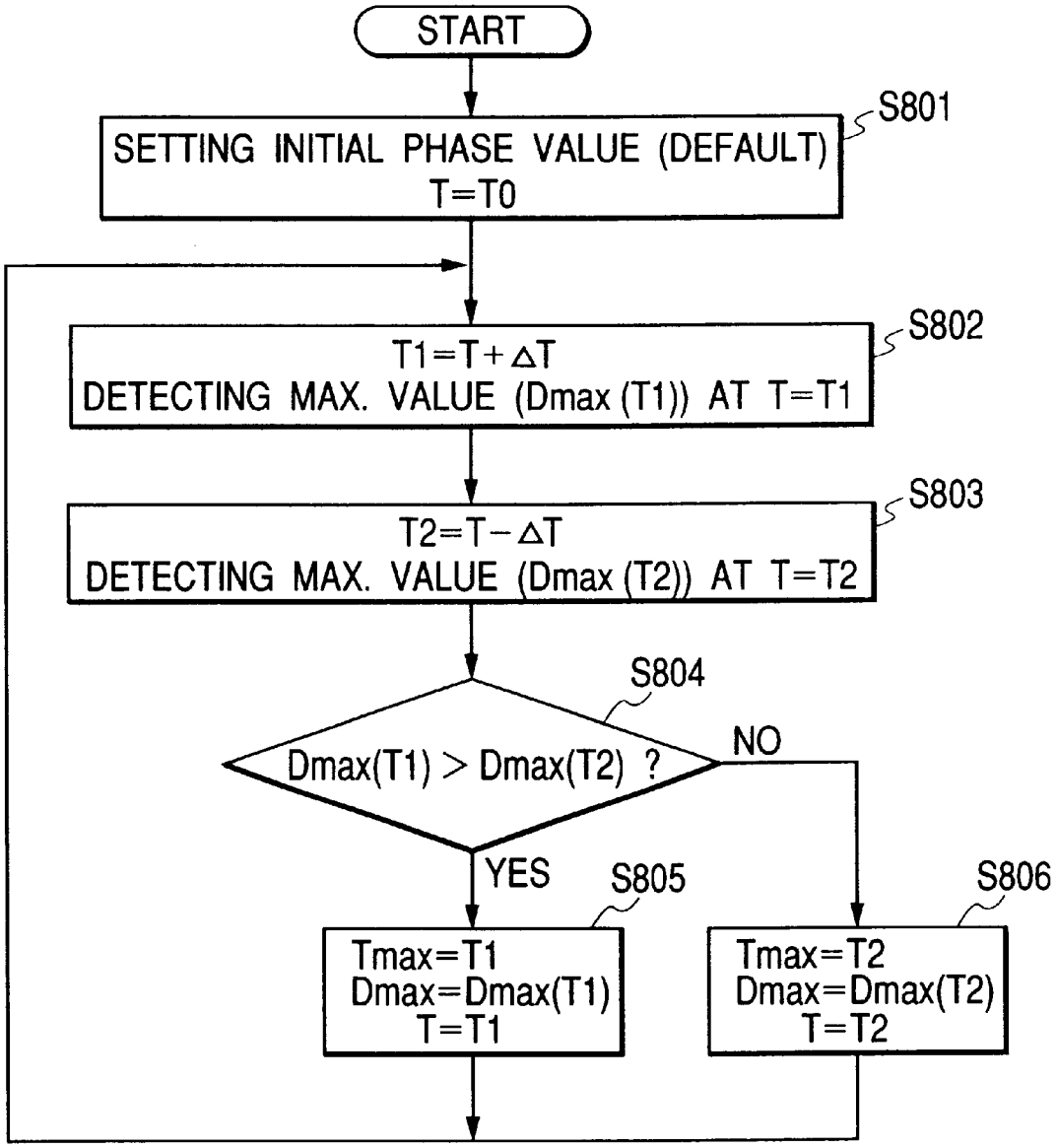
FIG. 8 is a flowchart illustrating the operation of a sixth embodiment.

FIG. 8 is a flowchart illustrating the control operation by CPU 7 according to the sixth embodiment.

As image data is input, the clock generation circuit 8 is first controlled to set the clock phase T to a predetermined value T0 (S801).

Next, the clock phase is set to T1=T+ΔT and input image data is sampled to detect a max value Dmax (T1) (S802). Next, the clock phase is set to T2=T−ΔT and input image data is sampled to detect a max value Dmax (T2) (S803).

Dmax (T1) is compared with Dmax (T2) (S804). If Dmax (T1) is larger, the T is set to an optimum phase Tmax, Dmax (T1) is set to the max value Dmax, and T1 is set to T to thereafter sample an input image signal (S805). If Dmax (T2) is equal to or smaller than Dmax (T1), T2 is set to the optimum phase Tmax, and Dmax (T2) is set to Dmax (T2) to thereafter sample an input image signal (S806). The line from which the max value is obtained at S802 and S803 may be any line of input image data, and it is not necessary to obtain the max value for respective two lines as in the fourth and fifth embodiments.

Thereafter, the flow returns to S802 to repeat similar processes.

As above, in this embodiment, the optimum clock phase is searched while the present clock phase is changed in the phase lead or lag direction so that the optimum clock phase can be set more quickly.

Next, the seventh embodiment of the invention will be described.

Figure 9:
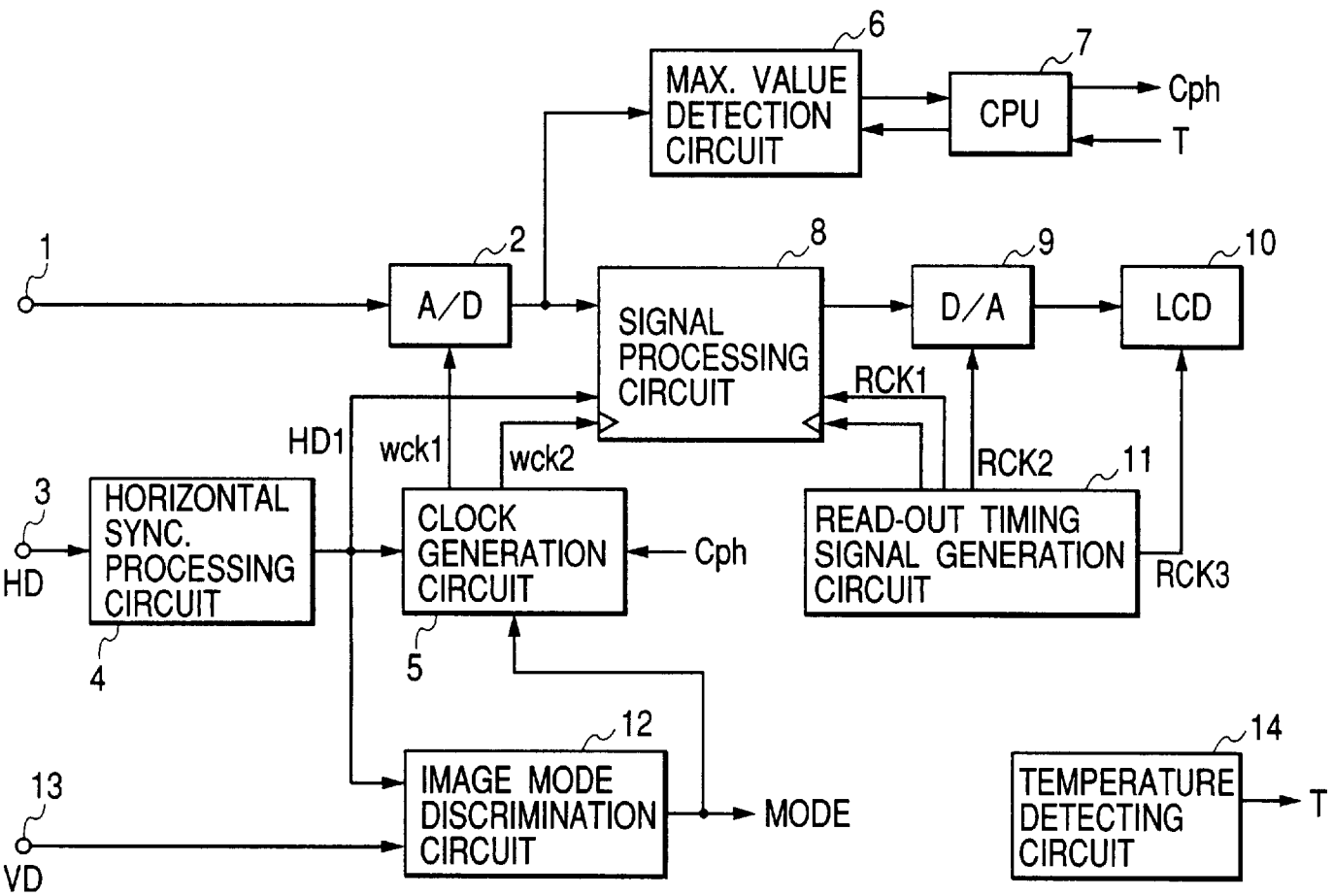
FIG. 9 is a block diagram showing a liquid crystal display apparatus using an image signal processing apparatus according to a seventh embodiment of the invention.

In FIG. 9, reference numeral 14 represents a temperature detecting circuit for detecting a temperature in the display apparatus. Other structures are the same as those shown in FIG. 1.

As the environmental temperature changes, the optimum sampling point changes depending upon the temperature characteristics of a delay amount of the horizontal sync signal and upon the temperature characteristics of the clock generation circuit 5 and A/D converter 2.

In this embodiment therefore, the temperature detecting circuit 14 provided in the display apparatus detects the temperature, and when the temperature T changes, adjusting the sampling phase for an image signal is again executed in the manner described in the above embodiments.

Figure 10:
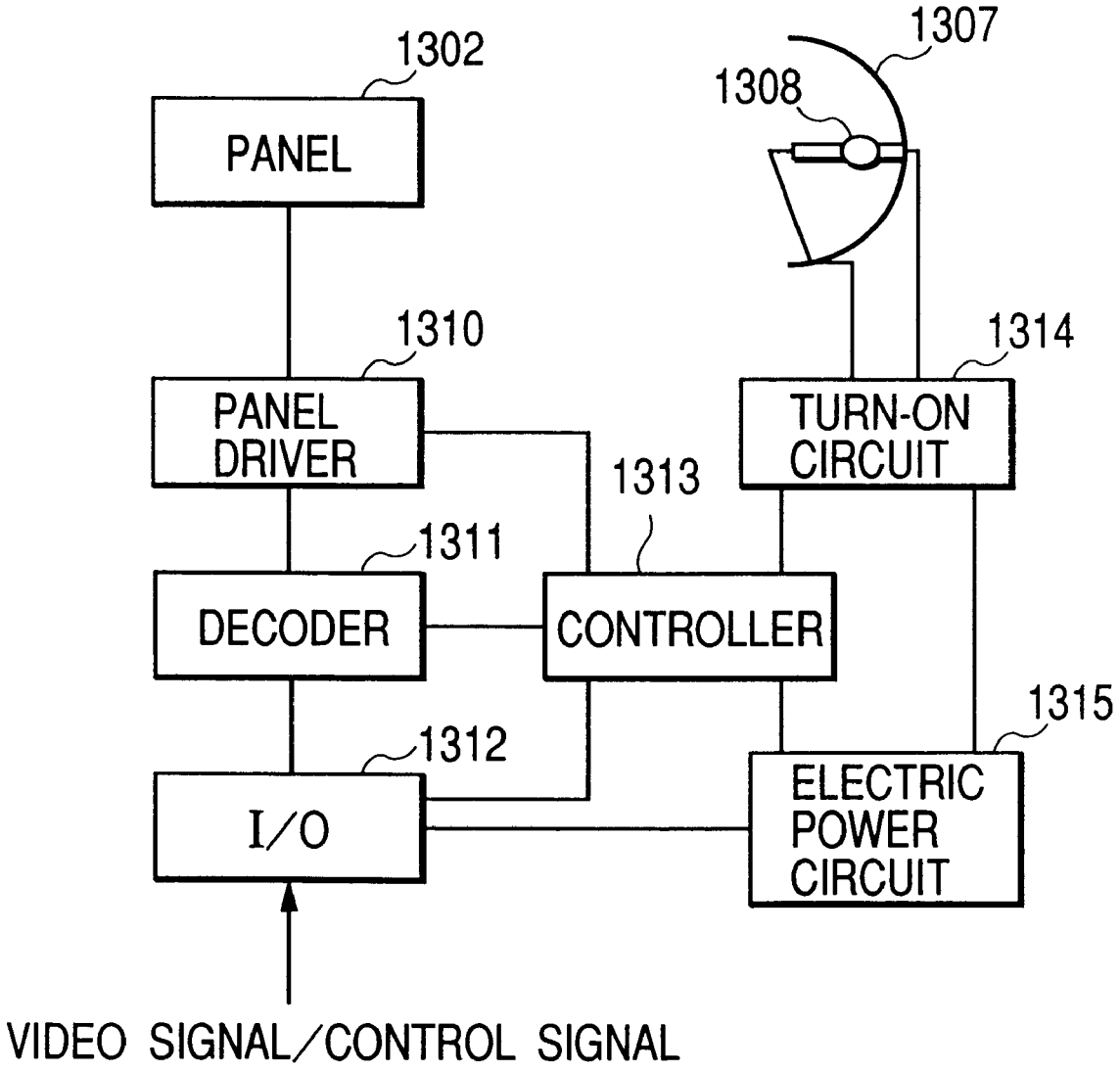
FIG. 10 is a block diagram showing a liquid crystal display apparatus using an image signal processing apparatus according to an eighth embodiment of the invention.

FIG. 10 is a block diagram showing a projection type liquid crystal display apparatus (liquid crystal projector) according to the eighth embodiment of the invention, the apparatus using the image signal processing apparatus of the above-described embodiments.

In FIG. 10, reference numeral 1310 represents a panel driver for generating: a liquid crystal drive signal by inverting the polarity of an RGB image signal and voltage-amplifying it by a predetermined amount; a drive signal for an opposing electrode; and various timing signals and the like, and also for adjusting the DC level of signals supplied thereto.

Reference numeral 1312 represents an I/O interface for changing various image signals and transmission control signals into standard image signals. Reference numeral 1311 represents a decoder for decoding the standard image signal supplied from the interface 1312 into an RGB primary color image signal and a sync signal, i.e., into an image signal suitable for the liquid crystal display panel 1302. Reference numeral 1314 represents a turn-on circuit with ballast for turning on an arc lamp 1308 with an elliptic reflector 1307. Reference numeral 1315 represents an electric power circuit for supplying power to each circuit block. Reference numeral 1313 represents a controller for controlling an unrepresented operation unit and the whole of the circuit blocks. The controller 1313 instructs the panel driver 1310 to operate in various ways, such as inverting the polarity, switching between fields during phase adjustment, setting a color and the like.

In the projection liquid crystal display apparatus of this embodiment, white light is radiated from the arc lamp 1308 such as a metal halide lamp to the liquid crystal panel 1302, and the image signal displayed on the reflection type liquid crystal panel 1302 is projected as reflected light upon the screen via a lens which is not shown. This apparatus can therefore operate as a projector for displaying a magnified image on a large screen.

In this embodiment, although a single plate type liquid crystal panel is used, a three-plate type projector may be realized by applying light of each color obtained by separating white light radiated from the arc lamp 1308 with dichroic mirrors or the like.

Further, although a transmission panel is used, light transmitted through the liquid crystal panel may be projected via a lens upon the screen.

By connecting the image signal processing apparatus of the first and fourth embodiments to the liquid crystal display apparatus via the interface 1312, it is possible to sample an image signal at the optimum phase.

Figure 11:
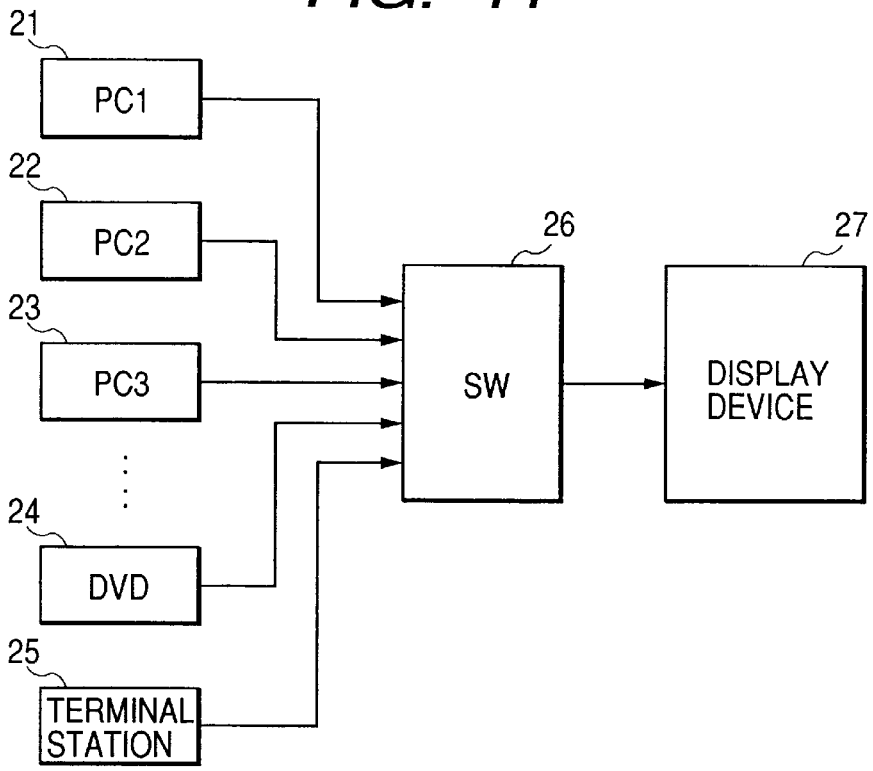
FIG. 11 is a block diagram showing a display switching system of a display apparatus using an image signal processing apparatus according to a ninth embodiment of the invention.

FIG. 11 is a block diagram showing a display apparatus according to the ninth embodiment of the invention. This display apparatus is used by switching between a plurality of image signal sources such as a computer, a DVD, and a video recorder, of a conference system, an education system and or the like.

In FIG. 11 reference numerals 21 and 23 represent personal computers PC1, PC3 which are used for displaying an image on a display apparatus 27 via an image signal switch 26. Reference numeral 24 represents a DVD, and reference numeral 25 represents an Internet terminal station for displaying an image on the display apparatus 27 via the switch 26, similar to the computers PC1, PC3.

In the conference system or education system which has the display apparatus 27 of a large screen apparatus and uses a plurality of PCs by switching therebetween as in this embodiment, the phases of the horizontal sync signal and image signal are different for each PC. Since PCs are switched by an image signal switching circuit by using long wires, the horizontal signal is influenced by the long wire and stitching circuit and made unsharp. It becomes more difficult to obtain an optimum sampling phase.

If a horizontal sync signal having a waveform integrated because of influence caused by the long wires for example, is input, the timing of a reference signal cannot be detected correctly. In this case, as described with FIG. 2F, if the sampling point is near the border between the preceding and succeeding pixels, uniform pixel data cannot be obtained and flickering may occur because of jitter.

In this embodiment, therefore, the image signal processing apparatus of the first and seventh embodiments shown in FIGS. 1 and 9 is used as an image signal input interface unit of the display apparatus 27. The image signal can therefore be sampled at an optimum phase and an image of high quality can be displayed.

In the first and seventh embodiments, the sampling phase is controlled by delaying the phase of a clock output from the circuit shown in FIG. 11. Instead, the clock phase may be changed by using a PLL which can adjust the phase relative to the horizontal sync signal HD, or by delaying the horizontal sync signal HD to be input to the clock generation circuit 5 by a delay element or the like.

A clock output from the clock generation circuit may be delayed, or a video signal to be sampled at the A/D converter may be delayed. In summary, any means can be used so long as it can control the sampling point of the video signal.

As the means for sampling the video signal, the A/D converter 2 is used. Instead, a sample-hold circuit or the like for sampling a video signal in an analog manner may be used.

The sampling phase may change with change of a phase delay caused by temperature margin, noises, power source and the like. In this connection, the optimum sampling point may be set with phase shift $\Delta T$ and therefore given some margin.

A storage medium as another embodiment of the invention will be described.

Although this invention can be realized by hardware, it may also be realized by a computer system having a CPU and a memory. If the invention is realized by the computer system, the memory constitutes the invention. Namely, the object of the invention can be achieved by supplying a system or apparatus with a storage medium storing software program codes realizing the functions of each embodiment described above, and by reading and executing the programs codes stored in the storage medium by CPU of the system and apparatus.

The storage medium for storing such program codes may be a semiconductor memory such as a ROM and a RAM, an optical disk, a magnetooptical disk, a magnetic medium, a CD-ROM, a floppy disk, a magnetic tape, a magnetic card, a nonvolatile memory card or the like.

The object of the invention can be achieved also in the case wherein a system or computer other than the system or apparatus shown in FIGS. 1, 9, 10 and 11 reads and executes the program codes stored in the storage medium to realize the functions and effects similar to each embodiment described above.

The object of the invention can also be achieved in the case wherein the functions and effects of each embodiment can be realized not only by an OS or the like running on a computer which OS executes a portion or the whole of actual processes, but also by writing the program codes read from the storage medium into a memory of a function expansion board inserted into a computer or of a function expansion unit connected to the computer and thereafter by executing a portion or the whole of actual processes.

Many widely different embodiments of the present invention may be constructed without departing from the spirit and scope of the present invention. It should be understood that the present invention is not limited to the specific embodiments described in the specification, except as difined in the appended claims.

What is claimed is:

1. An image signal processing apparatus, comprising:

clock generating means for generating a clock which is phase-synchronized with an input image signal;

sampling means for sampling the input image signal in response to the clock;

selecting means for selecting a sample having a value larger than adjacent samples from a plurality of samples output from said sampling means;

comparison means for comparing a plurality of selected samples selected by said selecting means with each other; and control means for detecting a maximum value of the plurality of selected samples in accordance with a comparison result of said comparison means, and for controlling said clock generating means to adjust a phase of the clock in accordance with the detection result of the maximum value.

2. An apparatus according to claim 1, wherein said control means obtains a difference signal between adjacent samples in an optional line in accordance with the comparison result and controls said clock generating means.

3. An apparatus according to claim 1, wherein said comparison means sequentially compares adjacent samples of the image signal and said control means controls said clock generating means in accordance with the comparison result.

4. An apparatus according to claim 1, further comprising temperature detecting means for detecting a temperature in said apparatus, wherein said control means controls the phase of the clock in accordance with a detected temperature change.

5. An apparatus according to claim 1, wherein said control means controls said clock generating means in accordance with a comparison result between the maximum value of the selected samples selected from the plurality of samples sampled in response to a clock of a first phase and the maximum value of the selected samples selected from the plurality of samples sampled in response to a clock of a second phase different from the first phase.

6. An apparatus according to claim 1, further comprising output means for outputting an image signal output from said sampling means to a display device.

7. An apparatus according to claim 6, wherein the display device includes a liquid crystal display device.

8. An apparatus according to claim 6, wherein the display device includes a projection liquid crystal display device.

9. An apparatus according to claim 6, wherein said output means includes a signal processing circuit for executing a predetermined process on the image signal output from said sampling means, in response to the clock.

10. An apparatus according to claim 6, further comprising display means for displaying an image of the image signal output from said sampling means.

11. An image signal processing apparatus, comprising:

clock generating means for generating a clock which is phase-synchronized with an input image signal;

sampling means for sampling the input image signal in response to the clock;

mode switching means for switching a mode of said apparatus among a plurality of modes including a first mode wherein said clock generating means generates a first clock having a first phase and said sampling means samples the input image signal in response to the first clock, and a second mode wherein said clock generating means generates a second clock having a second phase different from the first phase and said sampling means samples the input image signal in response to the second clock;

selecting means for selecting a sample having a value larger than adjacent samples from a plurality of samples output from said sampling means; and control means for adjusting a phase of the clock generated by said clock generating means in accordance with (i) a maximum value of the selected samples selected by said selecting means from the plurality of samples obtained in the first mode, and (ii) a maximum value of the selected samples selected by said selecting means from the plurality of samples obtained in the second mode.

12. An apparatus according to claim 11, wherein said control means detects a maximum value of levels of the input image signal in an image area in accordance with the comparison result.

13. An apparatus according to claim 11, wherein said control means obtains a difference signal between adjacent samples in an optional line in accordance with the comparison result and controls said clock generating means.

14. An apparatus according to claim 11, wherein said comparison means sequentially compares adjacent samples of the image signal and said control means controls said clock generating means in accordance with the comparison result.

15. An apparatus according to claim 11, further comprising temperature detecting means for detecting a temperature in said apparatus, wherein said control means controls the phase of the clock in accordance with a detected temperature change.

16. An apparatus according to claim 11, further comprising output means for outputting an image signal output from said sampling means to a display device.

17. An apparatus according to claim 16, wherein the display device includes a liquid crystal display device.

18. An apparatus according to claim 16, wherein the display device includes a projection liquid crystal display device.

19. An apparatus according to claim 16, wherein said output means includes a signal processing circuit for executing a predetermined process on the image signal output from said sampling means, in response to the clock.

20. An apparatus according to claim 16, further comprising display means for displaying an image of the image signal output from said sampling means.

21. An image signal processing apparatus, comprising:

clock generating means for generating a clock which is phase-synchronized with an input image signal;

sampling means for sampling the input image signal in response to the clock;

mode switching means for switching a mode of said apparatus among a plurality of modes wherein said clock generating means generates a plurality of clocks having phases different from each other by a predetermined amount;

selecting means for selecting a sample having a value larger than adjacent samples from a plurality of samples output from said sampling means; and control means for detecting, in each of the plurality of modes, a maximum value of the samples selected by said selecting means from the plurality of samples, and for adjusting a phase of the clock generated by said clock generating means in accordance with the maximum values detected in the plurality of modes.

22. An apparatus according to claim 21, wherein the predetermined amount is associated with one pixel period of the image signal.

23. An image signal processing method, comprising the steps of:

generating a clock which is phase-synchronized with an input image signal;

sampling the input image signal in response to the clock;

selecting a sample having a value larger than adjacent samples from a plurality of samples output in said sampling step;

comparing a plurality of selected samples selected in said sample selecting step with each other; and detecting a maximum value of the plurality of selected samples in accordance with a comparison result obtained in said detecting sample comparison steps, and controlling said clock generating step to adjust a phase of the clock in accordance with the detection result of the maximum value.

24. An image signal processing method comprising the steps of:

generating a clock which is phase-synchronized with an input image signal;

sampling the input image signal in response to the clock;

switching a mode of said apparatus among a plurality of modes including a first mode wherein said clock generating step generates a first clock having a first phase and said sampling step samples the input image signal in response to the first clock, and a second mode wherein said clock generating step generates a second clock having a second phase different from the first phase and said sampling step samples the input image signal in response to the second clock;

selecting a sample having a value larger than adjacent samples from a plurality of samples output in said sampling step; and adjusting a phase of the clock generated in said clock generating step in accordance with (i) a maximum value of the selected samples selected in said selecting step from the plurality of samples obtained in the first mode, and (ii) a maximum value of the selected samples selected in said selecting step from the plurality of samples obtained in the second mode.

25. A computer readable storage medium storing program codes for realizing an image signal processing method, the program codes comprising the steps of:

generating a clock which is phase-synchronized with an input image signal;

sampling the input image signal in response to the clock;

selecting a sample having a value larger than adjacent samples from a plurality of samples output in said sampling step;

comparing a plurality of selected samples selected in said sample selecting step, with each other; and detecting a maximum value of the plurality of selected samples in accordance with a comparison result obtained in said detecting samples comparison step, and controlling said clock generating step to adjust a phase of the clock in accordance with the detection result of the maximum value.

26. A computer readable storage medium storing program codes for realizing an image signal processing method, the program codes comprising the steps of:

generating a clock which is phase-synchronized with an input image signal;

sampling the input image signal in response to the clock;

switching a mode of said apparatus among a plurality of modes including a first mode wherein said clock generating step generates a first clock having a first phase and said sampling step samples the input image signal in response to the first clock, and a second mode wherein said clock generating step generates a second clock having a second phase different from the first phase and said sampling step samples the input image signal in response to the second clock;

selecting a sample having a value larger than adjacent samples from a plurality of samples output in said sampling step; and adjusting a phase of the clock generated in said clock generating step in accordance with (i) a maximum value of the selected samples selected in said selecting step from the plurality of samples obtained in the first mode and (ii) a maximum value of the selected samples selected in said selecting step from the plurality of samples obtained in the second mode.

* * * * *

UNITED STATES PATENT AND TRADEMARK OFFICE

CERTIFICATE OF CORRECTION

PATENT NO. : 6,724,381 B2
DATED : April 20, 2004
INVENTOR(S) : Yukihiko Sakashita It is certified that error appears in the above-identified patent and that said Letters Patent is hereby corrected as shown below:

Title page,
Item [56], References Cited, FOREIGN PATENT DOCUMENTS,
"JP 402280820A 10/1990" should read -- JP 2-260820A 10/1990 --.

Drawings,
Sheet 7, Figure 7, S704, "Dir=1" should read -- Dir=0 --.

Column 13,
Line 29, "steps," should read -- step, --.

Signed and Sealed this

Third Day of May, 2005

JON W. DUDAS
*Director of the United States Patent and Trademark Office*